United States Patent [19]

Hinger

[11] Patent Number: 4,708,746

[45] Date of Patent: Nov. 24, 1987

[54] METHOD THE HYDROLYTIC SPLITTING OF ACID TREATED COMMINUTED CRUDE CELLULOSE WITH STEAM

[75] Inventor: Klaus-Jürgen Hinger, Stuttgart, Fed. Rep. of Germany

[73] Assignee: Werner & Pfleiderer, Fed. Rep. of Germany

[21] Appl. No.: 683,183

[22] Filed: Dec. 18, 1984

Related U.S. Application Data

[63] Continuation-in-part of Ser. No. 443,854, Nov. 22, 1982, abandoned.

[30] Foreign Application Priority Data

Dec. 15, 1981 [DE] Fed. Rep. of Germany ..... 3149587

[51] Int. Cl.[4] ..... C13K 1/02

[52] U.S. Cl. ..... 127/37; 127/42; 162/14; 162/21; 162/47; 162/68

[58] Field of Search ..... 162/68, 47, 14, 15, 162/16, 76, 19, 18, 21, 22, 24, 46; 127/37, 42, 43

[56] References Cited

U.S. PATENT DOCUMENTS

| | | | |
|---|---|---|---|
| 2,356,500 | 8/1944 | Boinot | 127/37 |
| 3,640,768 | 2/1972 | Eickemeyer | 127/37 |
| 4,274,911 | 6/1981 | Kroneld et al. | 162/68 |
| 4,401,510 | 8/1983 | Olson et al. | 162/19 |
| 4,461,648 | 7/1984 | Fuody | 127/37 |

FOREIGN PATENT DOCUMENTS

| | | | |
|---|---|---|---|
| 2803465 | 8/1979 | Fed. Rep. of Germany | 162/14 |

OTHER PUBLICATIONS

Grethlein, "Comparison of the Economics of Acid and Enzymatic Hydrolysis of Newsprint"; Biotechnology & Bioengineering, vol. XX, pp. 503–525, 1978.

*Primary Examiner*—Steve Alvo

*Attorney, Agent, or Firm*—Laff, Whitesel, Conte & Saret

[57] ABSTRACT

A method for acid-catalyzed hydrolytic splitting of cellulose to give a high yield in sugar with a minimal expenditure in energy, in particular, with the smallest possible charge of live steam. Admission of steam is performed in a plurality of successive, discrete reaction stages having in each case defined temperature and pressure values in such a manner that the temperature rises from one stage to the next while the reaction time decreases and a rapid expansion takes place subsequently to the last reaction stage. A high pressure poured bed reactor is used for performing this method.

1 Claim, 5 Drawing Figures

I, II, III = hydrolysis stages
U = conversion of cellulose in %
A = yield in sugar in %
S = selectivity for sugar in %

$\frac{A}{100} = \frac{U}{100} \quad \frac{S}{100}$

METHOD THE HYDROLYTIC SPLITTING OF ACID TREATED COMMINUTED CRUDE CELLULOSE WITH STEAM

This is a continuation-in-part of U.S. application Ser. No. 443,854 filed Nov. 22, 1982 and now abandoned.

FIELD OF THE INVENTION

This invention relates to a method and an apparatus for the hydrolytic splitting of cellulose.

BACKGROUND OF THE INVENTION

In a process of whole power-economical development, alcohol is gaining increasing importance as a fuel or fuel additive. Alcohol for such purposes can be produced from cellulose or cellulose-containing biomatter in two stages, i.e. by first hydrolysing cellulose to sugar and then fermenting this sugar to form ethanol. Whilst the fermentation of sugar to ethanol is technically well mastered, the hydrolysis of the cellulose remains a critical procedural step which determines the overall profitability of the method.

DISCUSSION OF PRIOR ART

In the methods known to the inventor (based essentially on Bergius and Scholler: German patent specification No. 577 850) of acid-catalysed hydrolysis of cellulose, shortcomings reside in particular in the fact that the energy contents of the alcohol produced are frequently less than the energy required for operating the whole plant, which energy must be made available primarily in the form of heating steam and electric current.

Thus, for example, in German patent specification Nos. 15 67 350 and 15 67 335 there are described percolator-solid bed reactors for a semicontinuous hydrolysis, wherein dilute sulphuric acid drips in batches over a solid bed of wood shavings and wherein cellulose is converted to glucose at a yield of about 50% at a hydrolysis temperature of 120° to 145° C. and a residence time of 15 to 60 minutes. Besides the relatively disadvantageous yield in glucose, a high specific energy supply is required in this case.

A substantial theoretical impetus for improvements resulted from the publication by Hans E. Grethlein in the journal *Biotechnology and Bioengineering,* vol. II (1978) pages 503 to 525, 'Comparison of the Economics of Acid and Enzymatic Hydrolysis of Newsprint'. It was claimed therein that a high yield in glucose, relative to the ALPHA-cellulose used, may be obtained if the hydrolysis temperatures are increased to 250° C. to up to 300° C. at pressures of 40 to 90 bar, and if dilute sulphuric acid at a concentration of up to 2,0% is used and if the hydrolysis time is extremely short.

OBJECTS AND SUMMARY OF THE INVENTION

The present invention provides a method of hydrolytically splitting cellulose, which method comprises treating comminuted crude cellulose pulp with acid, draining the pulp and subsequently allowing steam to react therewith at increased pressure and elevated temperature in a reactor vessel, wherein the admission of steam is effected in a number of successive, discrete reaction stages at defined temperature and pressure values in each case in such a manner that the temperature rises from one stage to the next stage, that the reaction time decreases, and that a rapid expansion is effected subsequent to the last reaction stage.

The invention enables high yields of more than 60% of fermentable sugar, relative to the cellulose used, to be obtained. The energy consumption is kept as low as possible, in particular less than 0.5 kg of steam per kg of dry substance and less than 0.01 kwh of motive energy per kg of dry substance. The capital expenditure remains within a justifiable range and the method itself, as well as the by-products to be removed, have no harmful effect on the environment.

Experimental studies of the kinetics of hydrolysis were carried out and through which the theoretical fundamentals were complemented and completed for a technical application. The experiments established that the yield in fermentable sugar passes through a maximum as a function of the reaction time. The maximum is higher and narrower at rising temperatures and lies at short residence times. The selectivity for fermentable sugar falls off mole slowly at higher temperatures with increasing conversion. These results, which will be described below in conjunction with a practical example, lead to the conclusion that the desired maximal yield in sugar can be obtained in a particularly advantageous manner by timed temperature control.

By the adjustment of the reaction time to the respective temperature stage, the respective maximum yield can be realized so that the highest possible overall yield can be obtained. In principle, the parameter temperature may be freely selected within wide ranges, provided that the appropriate decrease of the reaction time with increasing temperature is ensured. The number of reaction stages is selected so that the ratio of the data for the adjustment of the respective stage, to the reaction time of this stage is sufficiently high and can be satisfactorily controlled within the course of an industrial process. By operating with different reaction stages it is furthermore possible for the supply of steam not to take place continuously or at one go, but to be effected in accordance with the individual reaction stages. This is a factor which allows, in principle, a very advantageous utilization of the total quantity of steam prepared.

Conveniently, the reaction time of successive reaction stages is selected so as to be approximately exponentially decreasing as a function of the increasing reaction temperature. This provides an advantageous possibility of quantitatively determining the individual reaction stages. The connection described therein between the reaction temperature and reaction time renders it feasible to set the temperature stages so that technically controllable reaction times result.

If desired, after reaching the last reaction stage, a rapid step-like expansion in accordance with the reaction stages passed through, is effected, wherein steam from different expansion stages is conducted to separate pressure reservoirs and the waste steam of a (n+1)st stage is used in a quasi-continuous mode of operation to control the reaction conditions of a (n)th reaction stage of the respective next complete reaction stage course. By this means the aimed at highest possible utilization of the steam used is obtained. In this case that the method of the invention is intended to be performed quasicontinuously, i.e. that a plurality of reaction stage courses succeed one another. In this manner the advantages of a continuous manner of operation is combined with the advantageous situation concerning the yield in discontinuous methods.

Conveniently, the waste steam of the last expansion stage is used for preheating the crude cellulose material. This procedure enables the amount of hot steam required to be minimised.

An apparatus for carrying out the invention can comprise a high pressure poured bed reactor. A poured bed reactor creates the necessary conditions for a short to very short reaction time since the reaction times of the stage can be adjusted very rapidly therein.

A preheating chamber may be arranged in the actual reactor vessel of the poured bed reactor and be connected to the vessel.

Owing to the preheaters the waste-heat can be utilized advantageously and in view of their association with the reaction vessel proper there are very short conveying paths for the products to be subjected to the hydrolysis.

Conveniently in the apparatus there is provided a substantially horizontal channel which leads to the preheating chamber and supports sealingly a push rod longitudinally displaceable in the channel, a material storage tank which ends in said channel being arranged above the channel and the push rod sealing in its one end position the material storage tank and the preheating chamber.

In this embodiment, a particularly advantageous possibility of feeding the starting material is possible, enabling in particular also a quasicontinuous operation.

If desired, the reactor vessel terminates at the top and at the bottom in an intake valve and product discharge valve and at least a portion thereof is conically shaped.

By means of this construction of the reactor vessel, a good product fluidization is obtained while steam is fed in, and an advantageous separation of product and steam occurs on steam expansion. The sealing forces for the inlet and outlet valve are provided by the excess pressure in the interior of the reactor vessel, so that the hydraulic or pneumatic control devices can operate with only slight forces.

Preferably the product inlet valve is operable by way of an operating rod extending through the preheating chamber and wherein stripping devices are provided about the rod.

The stripping devices remove cellulose remnants which adhere to the operating rod in the preheating chamber during the preheating. In addition, water sprays may be provided for cleaning the valve closing members.

A ring nozzle channel may be connected in the region of the underside of the reactor vessel to a steam feed pipe.

This results in the material to be hydrolysed to be fluidized in the reactor vessel and being surrounded on all sides by condensing water vapour. This prevents the formation of lumps which would prolong the heating up times.

The rapid expansion which is important for kinetic reasons, at the end of each timed stage is also promoted by the arrangement of a ring nozzle channel connected in the region of the top side of the reactor vessel to a steam discharge pipe. The maximum rate of expansion may be only so high that no hydrolysis product or remaining starting material escapes from the reactor vessel through the steam outlet pipe.

Conveniently at least one compressed steam reservoir is connected to a steam feed pipe and a steam discharge pipe so that it may be shut-off.

By means of this embodiment the realization of a live-steam-saving procedural step is possible. A pipe may lead to the preheating chamber and be connected to the steam discharge pipe so that it may be shut-off.

BRIEF DESCRIPTION OF THE DRAWINGS

Further features, advantages and particulars of the invention will be revealed in the following description of a preferred embodiment with reference to the accompanying drawings, in which.

DESCRIPTION OF A PREFERRED EMBODIMENT

Figure 3:
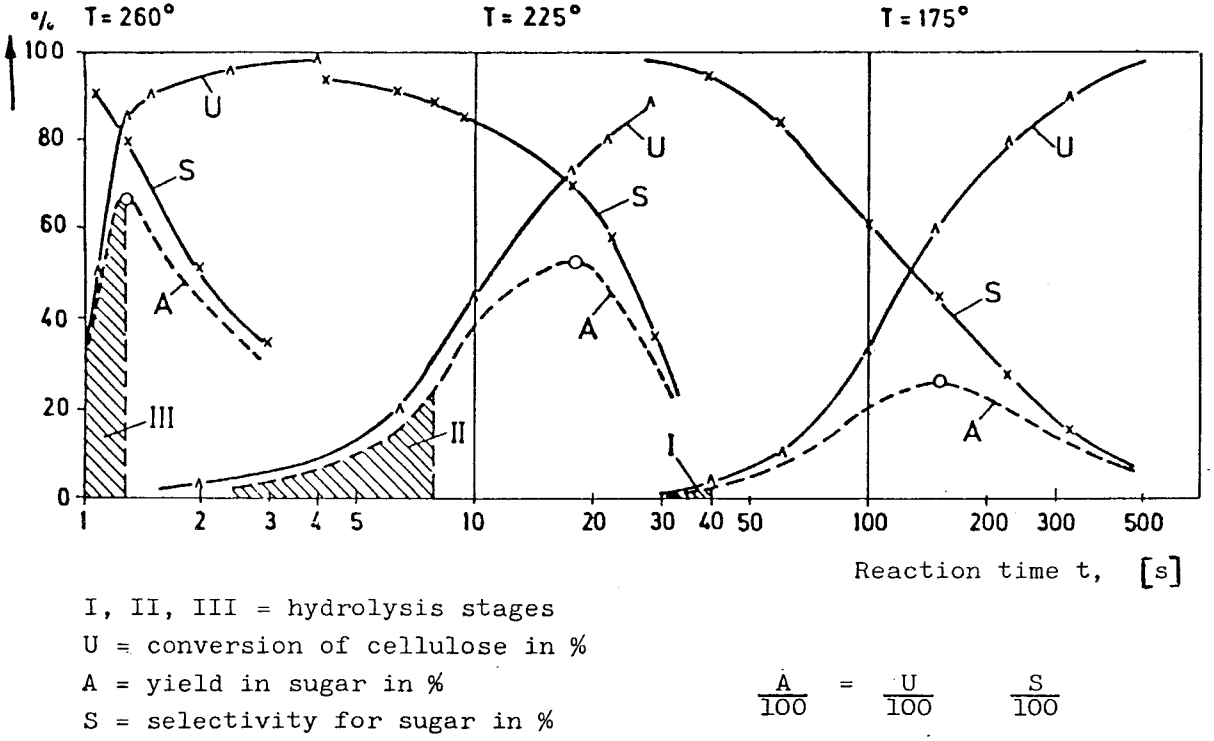
FIG. 3 shows a diagram of the experimentally obtained results for the dependence of the selectivity and conversion of cellulose and yield in sugar as a function of the rection time.
Figure 4:
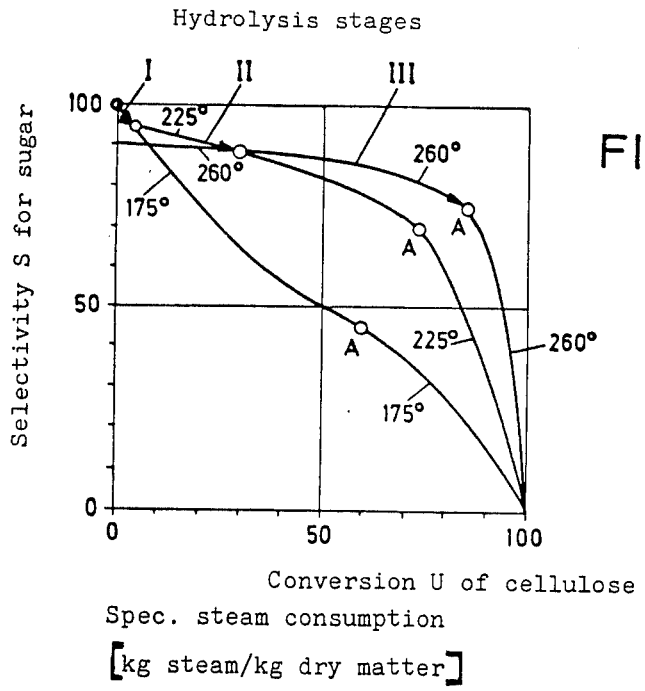
FIG. 4 shows a diagram of the dependence of the selectivity concerning sugar on the conversion of cellulose.

The fundamentals for the method of the invention form the experiments conducted in connection with the invention, the results of these experiments being summarized as follows:

As shows in FIG. 3 the yield A in fermentable sugar, i.e. the quantity of sugar relative to the alpha cellulose used, passes through a maximum which becomes higher and narrower with rising temperatures and lies in shorter residence times, as a function of the reaction time. These respective maxima for three temperature ranges are shown in FIG. 3. The conversion U of cellulose proceeds according to an exponential function from 0% in a residence time 0 to 100% in very long residence times (see also FIG. 3). The additional determination of the selectivity S for sugar, i.e. the quantity of sugar relative to the converted quantity of alpha cellulose reveals (as shown in FIG. 4) that the selectivity S at a temperature of 175° C. with a conversion of 0% starts at about 100% and then quickly drops with higher conversions. In contrast the selectivity S with a conversion of 0% at a temperature of 225° C. starts at 95%, or at 260° C. but only at 90%, and the drop always takes place slower with rising conversion. This phenomenon may be explained by a competitive reaction at higher temperatures.

Figure 2:
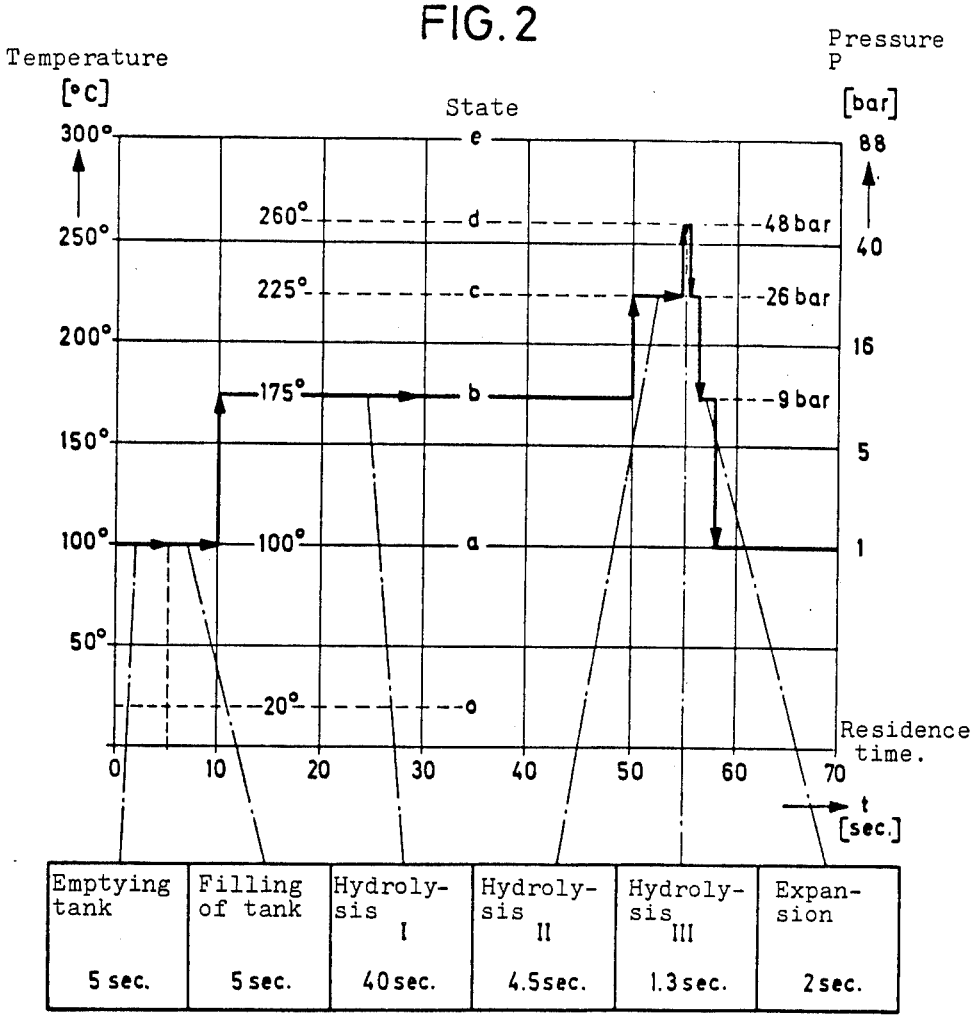
FIG. 2 is a diagram showing the individual reaction stages.

These experimental findings resulted in the fundamental idea of the invention that a maximal yield in sugar can be obtained in a particularly advantageous manner by means of a timed temperature control. On the basis of the results of the experiments illustrated in FIGS. 3 and 4 a reaction stages course is provided, as illustrated in FIG. 2, as an advantageous possibility of performing the method of the invention.

Accordingly, the material to be hydrolysed, such as, for example, old paper, wood remnants, straw and the like, is first reduced in size, in a manner known per se, then impregnated in a dilute sulphuric acid or another suitable acid solution of 0.5 to 10% strength. Then it is mechanically drained to 10 to 80% of moisture and then poured loosely, again in comminuted form, into a preheating chamber of a reactor vessel. In the preheating chamber the starting material is heated from room temperature to 100° C. by means of waste steam from a previous reaction stages course, by condensation of the steam. The material is then fed from the preheating chamber into the actual reactor vessel.

In a first reaction stage I the cellulose conversion is now caused to rise from 0 to 4% at a temperature of 175° C. for a reaction time of 40 seconds. In a following stage II the conversion increases at a temperature of 225° C. during a reaction time of 4,5 seconds from 4% to 30%, and finally, the conversion is increased in a stage III at a temperature of 260° C. for a reaction time of 1,3 seconds from 30% to 85%. After the expiry of the reaction time in the last stage III the temperature is rapidly lowered by expanding the steam in the reaction vessel in order to prevent a further reaction which would decompose preferably the developed sugar.

One can perceive against the background of the experimental results that this mode of operation results in a greater yield in fermentable sugar than when the reaction temperature would be raised suddenly to 260° C. and the reaction would be allowed to proceed from 0 to 85%.

By means of the steam control described in the following by way of example, a minimal consumption of live steam results, in addition to a high yield. Provided that there are adjusted steam and energy balances in a reactor vessel in each reaction stage, one proceeds with a freely selected number of 3 stages as follows:

The quantity of steam required for heating the material from a state "a" (material preheated to 100° C.) to state "b" (reaction stage I) and bringing the pressure from pressure $p_1$ to $p_2$ in the reaction vessel equals that which is released in a step-like expansion from a state "c" (reaction stage II) to the state "b". A steam accumulator in state "b" is therefore able to supply the required heating steam for the change from state "a" to "b" from the steam of expansion supplied from the change of state "c" to "b".

The quantity of steam required for heating the material from state "b" to "c" and for charging the reactor to pressure $p_3$ is equal to that which is released on expanding from state "d" to state "c". A second steam accumulator in state "c" is therefore able to supply the required heating steam for the change from state "b" to "d" from the fed-in steam of expansion from the change from state "d" to "c".

The quantity of steam required to heat the material from state "c" to "d" and to bring the reaction vessel to pressure $p_4$ must be supplied from a steam generator. Its pressure $p_5$ is suitably selected to be very high, for example 100 bar so that the heating time from state "c" to "d" is very short in comparison to the reaction time.

The waste steam from the last expansion stage, i.e. the change from state "b" to "a", is utilized for preheating the material impregnated with acid in the preheating chamber. After effecting the preheating a new complete reaction stage course can be started.

Figure 5:
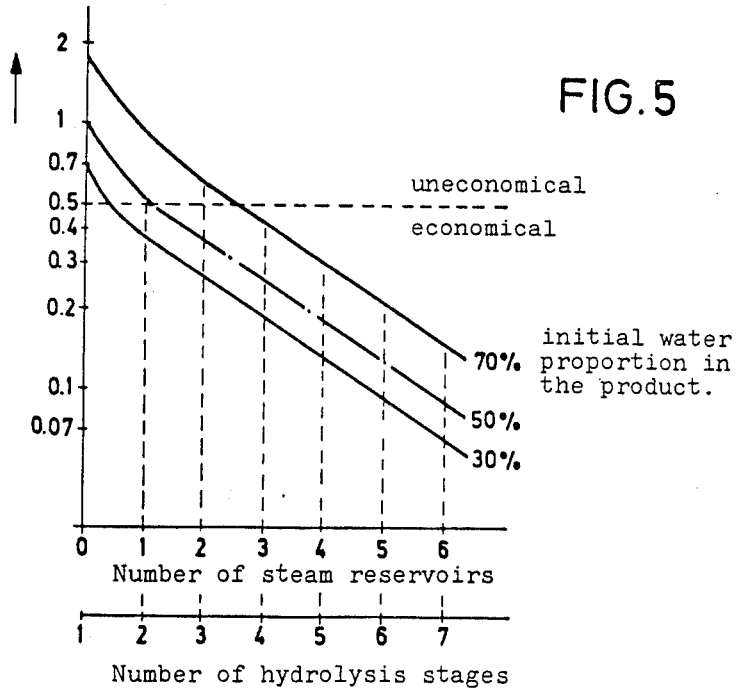
FIG. 5 shows the dependence of the specific steam consumption on the number of hydrolysis stages or of the steam accumulators.

As can be seen from FIG. 5, the specific quantity of steam $d_F$ required for the last heating-up step decreases with increasing number of stages or number of steam accumulators, respectively, and with decreasing water content of the impregnated, cullulose-containing material introduced.

Figure 1:
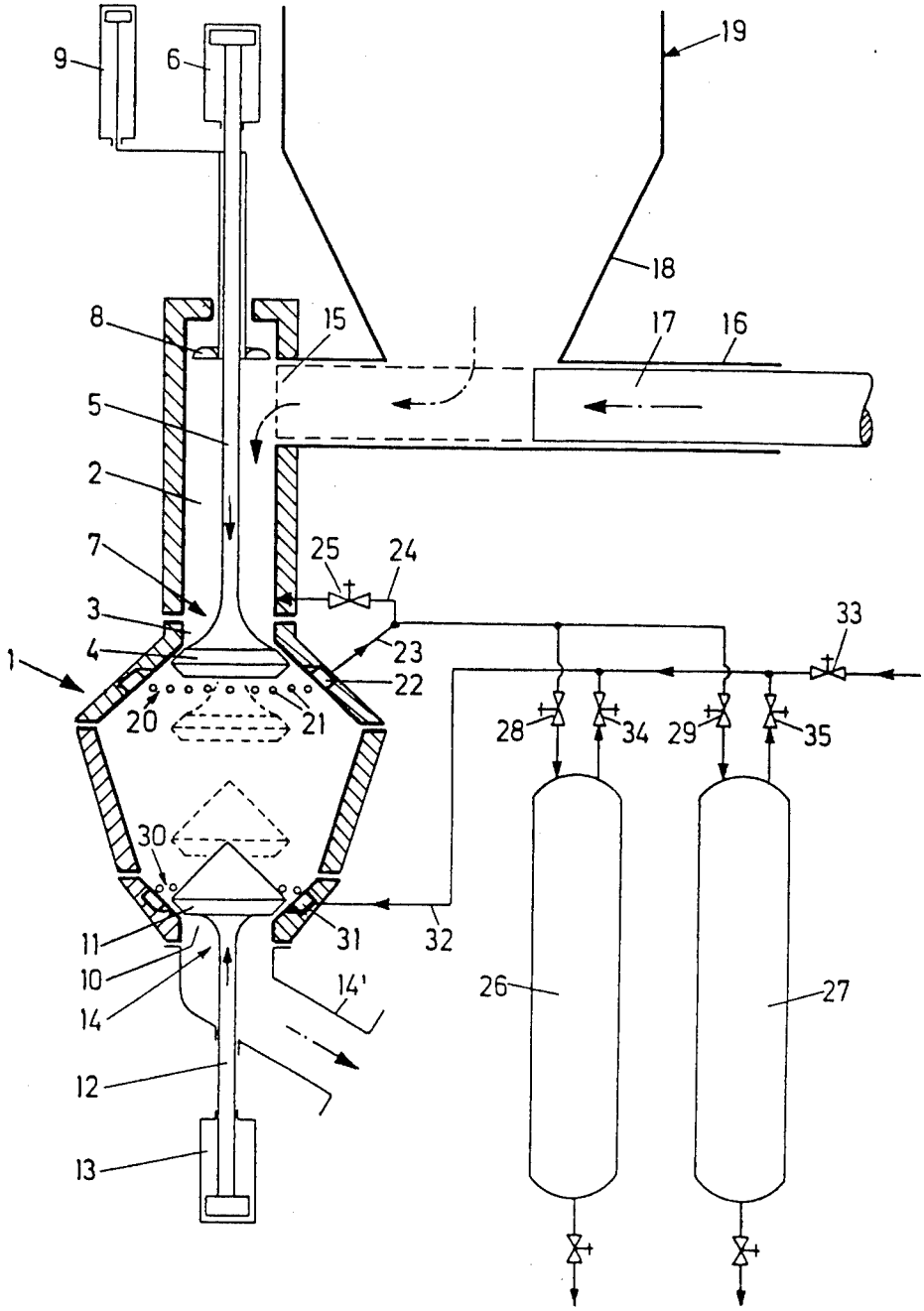
FIG. 1 shows a diagrammatic representation of an apparatus of the invention, including a section through a reactor vessel.

An apparatus illustrated in FIG. 1 serves for carrying out the method of the invention. This apparatus comprises a reactor vessel 1, a portion of which is concave. The reactor vessel is a high pressure tank. The inside of the vessel 1 is covered with an acid-resistant material of poor heat-conductivity, such as ceramics, in order to avoid condensation of the steam and resultant losses as far as possible. Furthermore, heat insulation (not shown in the drawing) is also provided.

A preheating chamber 2 is arranged above the reactor vessel 1. The former is connected to the reactor vessel via an intake 3. The intake 3 is closed by a movable valve locking member 4 which is indicated by broken lines in its open position. This valve locking member, together with an operating rod 5 extending through the preheating chamber 2 and hydraulic or pneumatic control devices 6 form an inlet valve 7. Stripping devices 8 are arranged around the operating rod 5 for wiping off remainders of the starting material adhering thereto, the stripping devices being operated by way of hydraulic or pneumatic driving mechanisms 9.

An outlet 10 which is closed by a valve locking member 11 is provided on the underside of the reactor vessel 1, the open position of said valve locking member also being indicated by broken lines. The valve locking member 11 is connected by way of an operating rod 12 to a hydraulic or pneumatic control device 13, wherein the operating rod 12 extends through a product outlet channel 14 adjoining the outlet 10. Valve locking member 11, operating rod 12 and control device 13, together, form a discharge valve 14. The preheating chamber 2 has a lateral inlet 15 leading into a horizontal channel 16 in which a longitudinally displaceable push rod 17 is sealingly supported. A funnel-like bottom portion 18 of a material storage tank 19 terminates from above in the channel 16.

Below the locking member 4 of the inlet valve 7, there is provided at the reactor vessel 1 a ring nozzle channel 20 having a plurality of steam admission nozzles 21. The ring nozzle channel 20 is connected to a steam discharge vent 22 and a steam discharge pipe 23. A pipe 24 extends from the steam discharge pipe 23 by way of a valve 25 to the preheating chamber 2, whilst the steam discharge pipe 23, in turn, is connected to compressed steam reservoirs 26 and 27. Valves 28 and 29 are associated with the compressed steam reservoirs 26 and 27, respectively.

A second ring nozzle channel 30 is disposed in the reactor vessel 1 above the locking member 11 of the discharge valve 14 and is connected to a steam intake 31 and a steam feed pipe 32. The steam feed pipe 32, in turn, is connected by way of valves 33 and 34 and 35 firstly to a live steam source (not shown) and secondly to the compressed steam reservoirs 26 and 27.

The apparatus according to the invention is so operated that the previously pre-impregnated, drained and comminuted cellulose-containing material is filled into the material storage tank 19. The funnel-shaped bottom portion 18, together with the channel 16 acts as metering trough which is limited in the starting position by the push rod 17 on the right hand side of FIG. 1. By a longitudinal movement of the push rod 17 the material is pushed into the preheating chamber 2 wherein the inlet valve 7 is in a closed position. In the final position the push rod 17 closes the inlet 15. No specially particular standards are required of the quality of this seal.

Waste steam from the last expansion stage of the respective previous reaction stage course is now passed with opened valve 25 by way of the pipe 24 into the preheating chamber 2. The material is heated to about 100° C. through the heat of condensation of the waste steam. The inlet valve 7 then opens so that the material may drop loosely from the preheating chamber 2 into the reaction vessel 1 whilst the discharge valve 14 is closed. By operating the stripping device 8 retained material remnants are prevented from forming undesirable bridges. On closing the inlet valve 7 the sealing area can be cleaned by a steam jet. The stripping device 8 and the push rod 17 also return to their initial position and are then ready to repeat the charging process.

In the reactor vessel 1 the reaction stages proceed in the aforedescribed manner by supplying steam successively from the compressed steam reservoirs 26 and 27 by way of the steam feed pipe 32 and finally live steam is supplied by opening the valve 33. The charged steam flows in by way of the ring nozzle channel 30 so that the material to be hydrolysed is fluidized in the reaction vessel.

On step-like expansion after the termination of the reaction stage course, steam is withdrawn by way of the upper ring nozzle channel 20 and the pipe 23 and conducted to the compressed steam reservoirs 26 or 27, respectively, depending on the reaction stage. The waste heat of the last expansion stage is supplied by way of the valve 25 to the preheating chamber 2. The apparatus is then ready again to proceed with a new reaction cycle in a quasi-continuous operation.

In one preferred embodiment the comminuted crude cellulose pulp is treated with acid in a concentration of 0.5 to 10% and draining the pulp, wherein the material to be hydrolysed is drained to 10 to 80% of moisture and heated to a temperature of approximately 100° C., and wherein in a first reaction stage I the temperature is increased to 175° C. and the pressure to approximately 9 bar during a reaction time of about 40 seconds, in a second reaction stage the temperature being increased to 225° C. and the pressure to about 26 bar during a reaction time of about 4.5 seconds, and in a third reaction stage the temperature being increased to approximately 260° C. and the pressure to 48 bar during a reaction time of 1.3 seconds, with a rapid expansion being effected subsequent to the third reaction stage within about 5 seconds of time.

Also in another embodiment after reaching the last reaction stage a rapid expansion is effected in such a way that the temperature is decreased to approximately 225° C. and the pressure to approximately 26 bar, then the temperature is decreased to approximately 175° C. and the pressure to approximately 9 bar, and finally the temperature is decreased to approximately 100° C. and the pressure to 1 bar, with the steam from different expansion stages being conducted to separate pressure reservoirs and the waste steam of a (n+1)st reaction stage being used to control the reaction conditions of a (n)th reaction stage of the respective next complete reaction stage course.

I claim:

1. Method of acid-catalyzed hydrolytic splitting of cellulose to produce sugar, which method comprises treating comminuted crude cellulose pulp with acid in a concentration of 0.5 to 10% and draining the pulp, wherein the material to be hydrolyzed is drained to 10 to 80% of moisture and heated to a temperature of approximately 100° C., placing the heated drained pulp in a reaction vessel, feeding steam into said reaction vessel in three successive discrete reaction stages, and wherein said steam being fed in a first reaction stage I to increase the temperature to 175° C. and the pressure to approximately 9 bar during a reaction time of about 40 seconds, said steam being successively fed in a second reaction stage to increase the temperature to 225° C. and the pressure to about 26 bar during a reaction time of about 4.5 seconds, and said steam being successively fed in a third reaction stage to increase the temperature to approximately 260° C. and the pressure to 48 bar during a reaction time of 1.3 seconds, and effecting a rapid expansion of said steam subsequent to the third reaction stage within about 5 seconds of time, and wherein steam from different expansion stages is conducted to separate pressure reservoirs and the waste steam of a (n+1)st stage is used to control the reaction conditions of a (n)th reaction stage of the respective next complete reaction stage course.

* * * * *